US008337645B2

(12) United States Patent
Vincoli

(10) Patent No.: US 8,337,645 B2
(45) Date of Patent: Dec. 25, 2012

(54) METHOD AND PLANT FOR HEAT TREATMENT OF METALLIC ELEMENTS

(75) Inventor: Armando Vincoli, Brescia (IT)

(73) Assignee: Estral S.p.A., Manerbio (IT)

( * ) Notice: Subject to any disclaimer, the term of this patent is extended or adjusted under 35 U.S.C. 154(b) by 353 days.

(21) Appl. No.: 12/849,853

(22) Filed: Aug. 4, 2010

(65) Prior Publication Data

US 2011/0006465 A1 Jan. 13, 2011

Related U.S. Application Data

(62) Division of application No. 11/946,404, filed on Nov. 28, 2007, now Pat. No. 7,897,101.

(30) Foreign Application Priority Data

Nov. 30, 2006 (IT) ..... BS2006A0208

(51) Int. Cl.
*F27B 9/24* (2006.01)
*C21B 15/00* (2006.01)
*C21D 9/00* (2006.01)

(52) U.S. Cl. ..... 148/559; 266/44; 266/249

(58) Field of Classification Search ..... 148/559; 266/44, 249

See application file for complete search history.

(56) References Cited

U.S. PATENT DOCUMENTS

| | | | |
|---|---|---|---|
| 3,254,778 | A | 6/1966 | Marland et al. |
| 4,404,043 | A | 9/1983 | Elhaus et al. |
| 4,495,001 | A | 1/1985 | Bennett et al. |
| 6,619,471 | B1 | 9/2003 | Downie et al. |
| 7,090,488 | B2 | 8/2006 | Murakami et al. |
| 2004/0115032 | A1 | 6/2004 | Ostermann et al. |
| 2005/0158685 | A1 | 7/2005 | Murakami et al. |

FOREIGN PATENT DOCUMENTS

| | | | |
|---|---|---|---|
| DE | 3726802 | A1 | 2/1989 |
| EP | 1469089 | A | 10/2004 |
| EP | 1475446 | A | 11/2004 |
| EP | 1705444 | A1 | 9/2006 |
| WO | 02061154 | A | 8/2002 |

OTHER PUBLICATIONS

International Search Report for EP 1705444 A1 Dated Jul. 10, 2006, pp. 1-2.

*Primary Examiner* — Stanley Silverman
*Assistant Examiner* — Alexander Polyansky
(74) *Attorney, Agent, or Firm* — Pearne & Gordon LLP

(57) ABSTRACT

A plant for the heat treatment of metallic elements (E) includes: at least a chamber (3) for containing the metallic elements (E) having at least one access opening (A1); a heater (4) of the chamber (3), operating on the chamber (3) for bringing the same at a predetermined temperature; a conveyor (15), connected with a respective actuator and acting on the metallic elements (E) for transferring these latter at the exiting and/or entering with respect to the chamber (3). The conveyor (15) has been positioned outside the chamber (15) during the functioning of the plant (1).

17 Claims, 13 Drawing Sheets

FIG 1
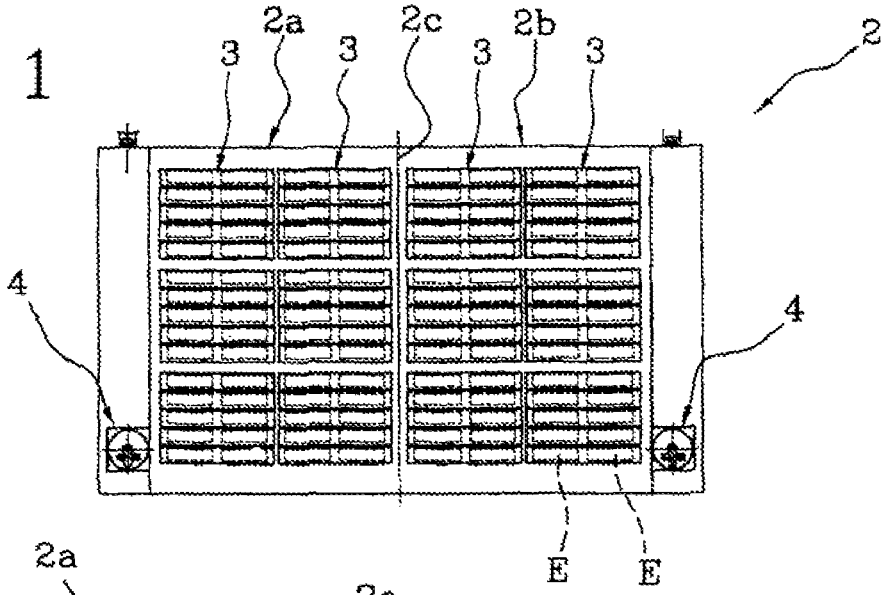
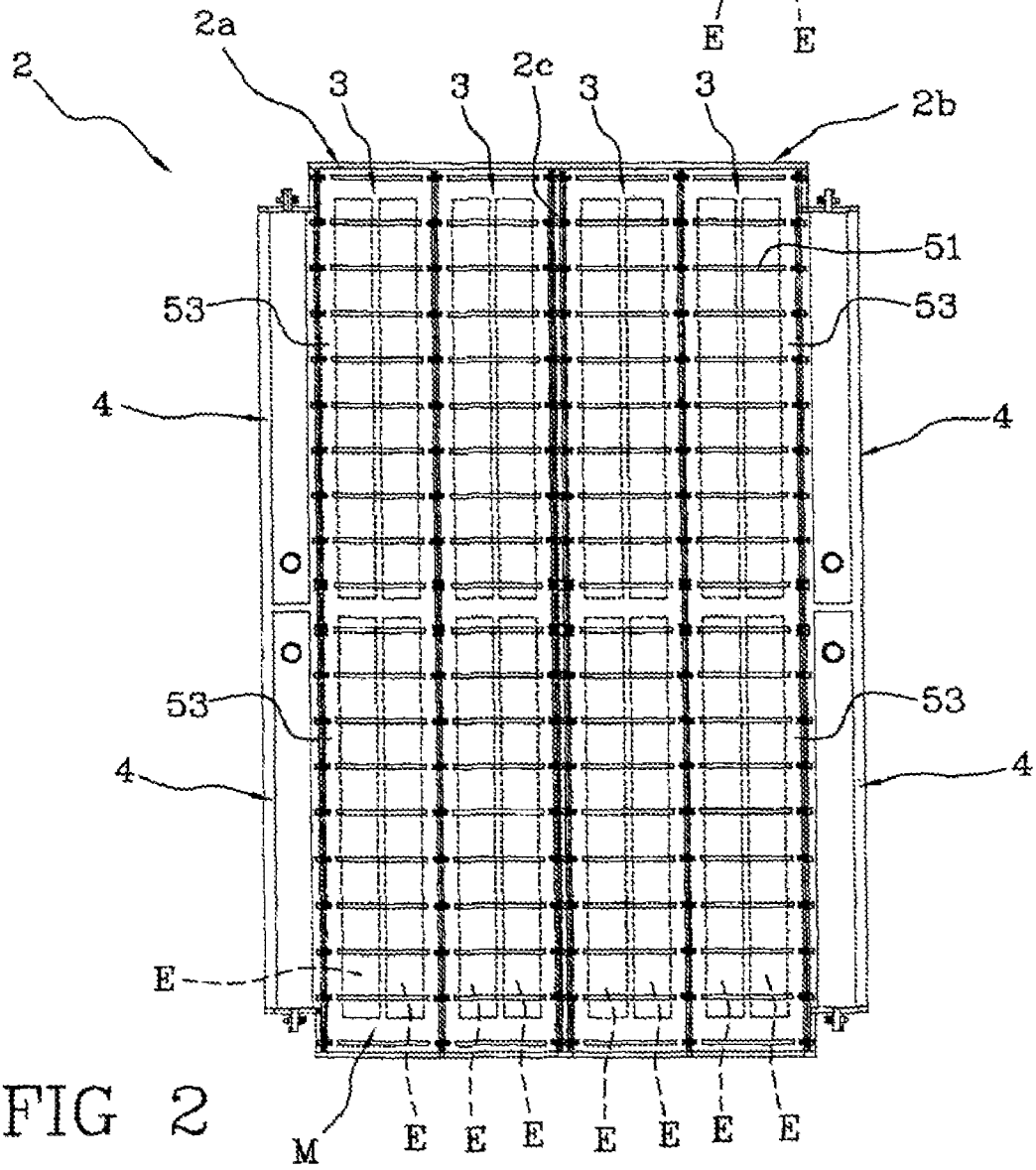
FIG 2

METHOD AND PLANT FOR HEAT TREATMENT OF METALLIC ELEMENTS

The aim of the present invention is a method and a plant for the heat treatment of metallic elements, in particular elements having a prevailing longitudinal dimension such as, for example, draw pieces, extrudates or metallic draft product.

Such kind of plant is particularly used for the ageing process of aluminium draw pieces, to which reference will be expressly made hereinafter, without losing for this reason in generality. The aging process of an aluminium draw piece commonly takes place downstream of previous extrusion, cooling, drawing and cutting steps.

It is well known that such aging process makes use of a furnace in which draw pieces are introduced and in which they remain for the time required for completing the heat treatment.

As it is known, such technology includes an internally dynamic furnace in which draw pieces are displaced between the inlet and the outlet of the furnace itself in a predetermined time and on multiple height levels, by way of a conveyor housed within the furnace itself. In a furnace of the type above described, which is object of the European patent application No. EP1705444 in the name of the same Applicant, the transport of the draw pieces takes place in parallel with their longitudinal extension, namely to their length. Such draw pieces are fed by an inlet placed at a side of the furnace, and moved forward towards an outlet placed from the opposite side of the furnace under the action of a conveyor, in particular support and advancing rollers, placed within the furnace and operated by electric motors. The rotating speed of the rollers, and therefore the advancing speed of the draw pieces, is opportunely calculated based on the time required by the draw piece for travelling the distance between the inlet and the outlet of the furnace, corresponding with an optimal residence time of the draw piece within the furnace.

It has been noted that this kind of furnace presents an important drawback.

In fact, such solution is rather expensive due to the need of thermally insulating all the operating mechanisms of the conveyor housed within the furnace, for preventing their degradation over time.

There are also known plants for the heat treatment of metallic elements, which employ proper metallic baskets for the transport of the metallic elements between following working stations of the plant, among which there is also the heating furnace. Such baskets are introduced within the furnace and therefore withdrawn at the end of the heat treatment for being transferred to following stations of the plant.

Disadvantageously, the use of baskets in the way just described produces a high heat dissipation, as the baskets coming from previous stations are placed within the furnace and, therefore, undergone a useless heating cycle together with the metallic elements supported therefrom, with a consequent remarkable energy waste. At the furnace outlet, the baskets cool down contacting with the environment outside the furnace, by dissipating the thermal energy previously acquired, with a remarkable waste of energy and a consequent bad management, also economic, of the plant.

In this situation, the technical task placed at the base of this invention is to propose a method and a plant for the heat treatment of metallic elements capable of obviating to the drawbacks above complained.

The main object of the present invention is to provide a method and a plant for the heat treatment of metallic elements which is able to directly operate on the metallic elements without the need of containment baskets for such metallic elements which must be uselessly displaced and heated together with the metallic elements themselves.

An object of the invention is also to provide a method and a plant for the heat treatment of metallic elements which allows to simultaneously treat metallic elements with different treatment cycles both as a temporal length and as treatment temperature.

A further object of the invention is to carry out a plant and a process which are of a simple realization and with a limited cost.

A further object of the invention is to provide a method and a plant capable of containing the occurrence of wear and degradation phenomena of the components of the plant itself, and in particular of movable components such as the means foreseen for the transfer of the metallic elements.

A further object of the invention is to provide a method and a plant for the heat treatment of metallic elements which is able to minimize the energy and in particular thermal dissipation within the plant itself.

These and other aims, which will better result during the following description are attained, in agreement with the present invention, by a plant for the heat treatment of metallic elements according to the contents of the description, and by a method for the heat treatment of metallic elements according to the contents of the appended claims.

BRIEF DESCRIPTIONOF THE DRAWINGS

Further features and advantages of the invention will better result from the description of a preferred but not exclusive embodiment of a method and a plant for the heat treatment of metallic elements, in accordance with what has been explained in detail below with the aid of the following figures:

FIG. 1 shows a front view of a first part of the plant according to the invention;

FIG. 2 shows a top and sectional view of the part of FIG. 1;

Figure 3:
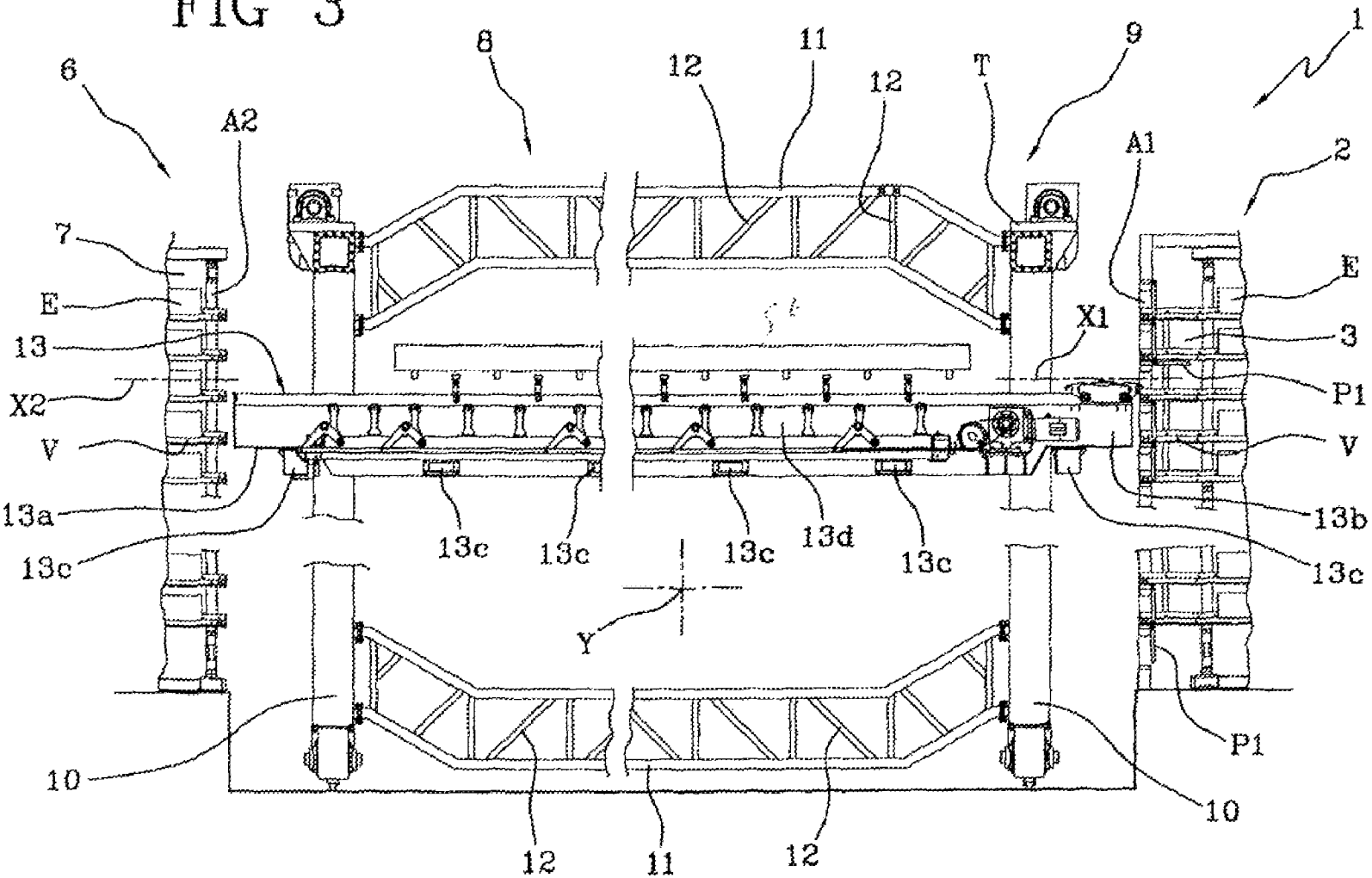
FIG. 3 shows a side view of a second part of the plant according to the invention, in a first working configuration.
Figure 6:
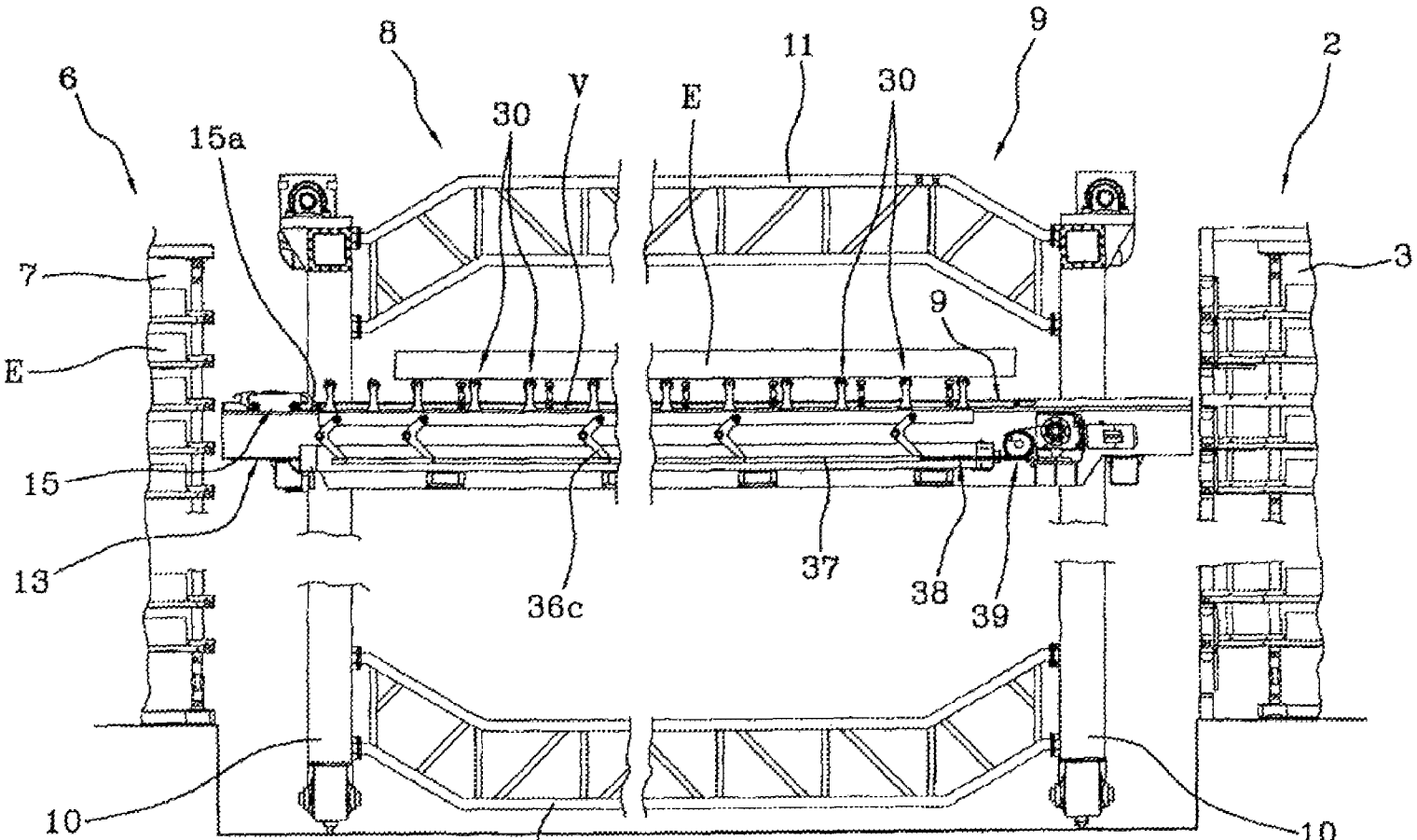
FIG. 6 shows a side view of the part of FIG. 3, in a fourth working configuration.
Figure 8:
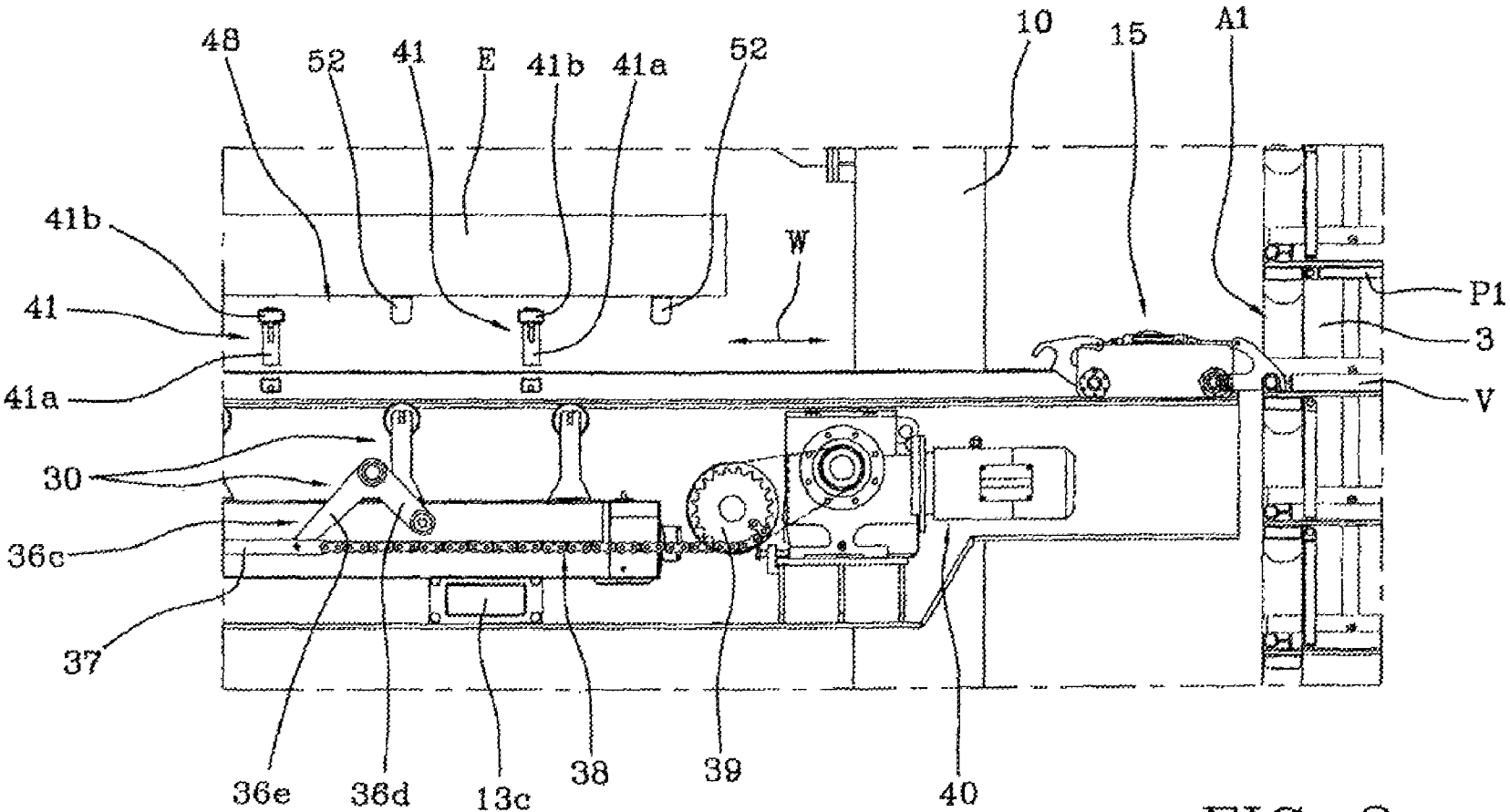
FIG. 8 shows a particular of the view of FIG. 3.
Figure 8A:
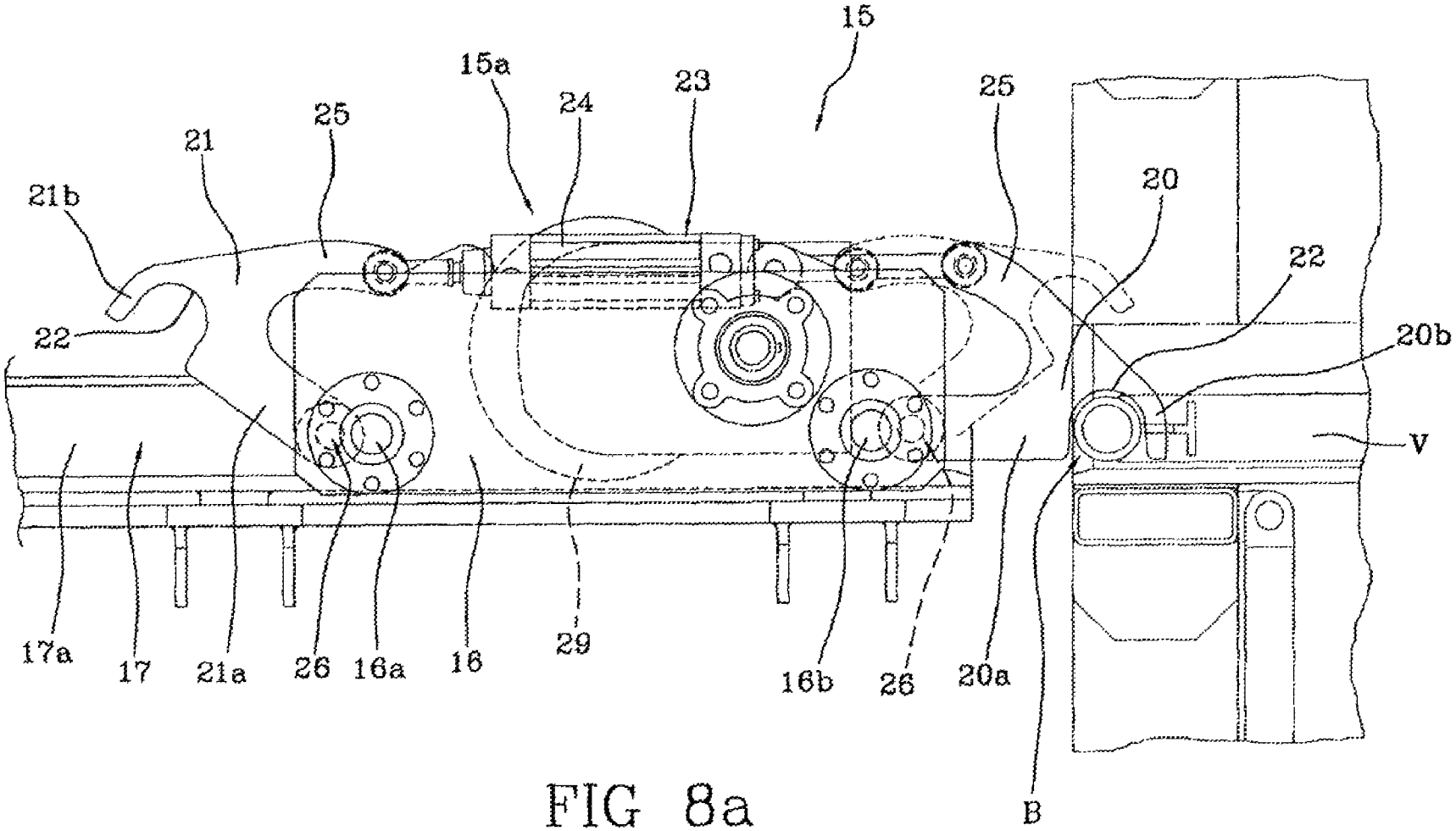
Figure 9:
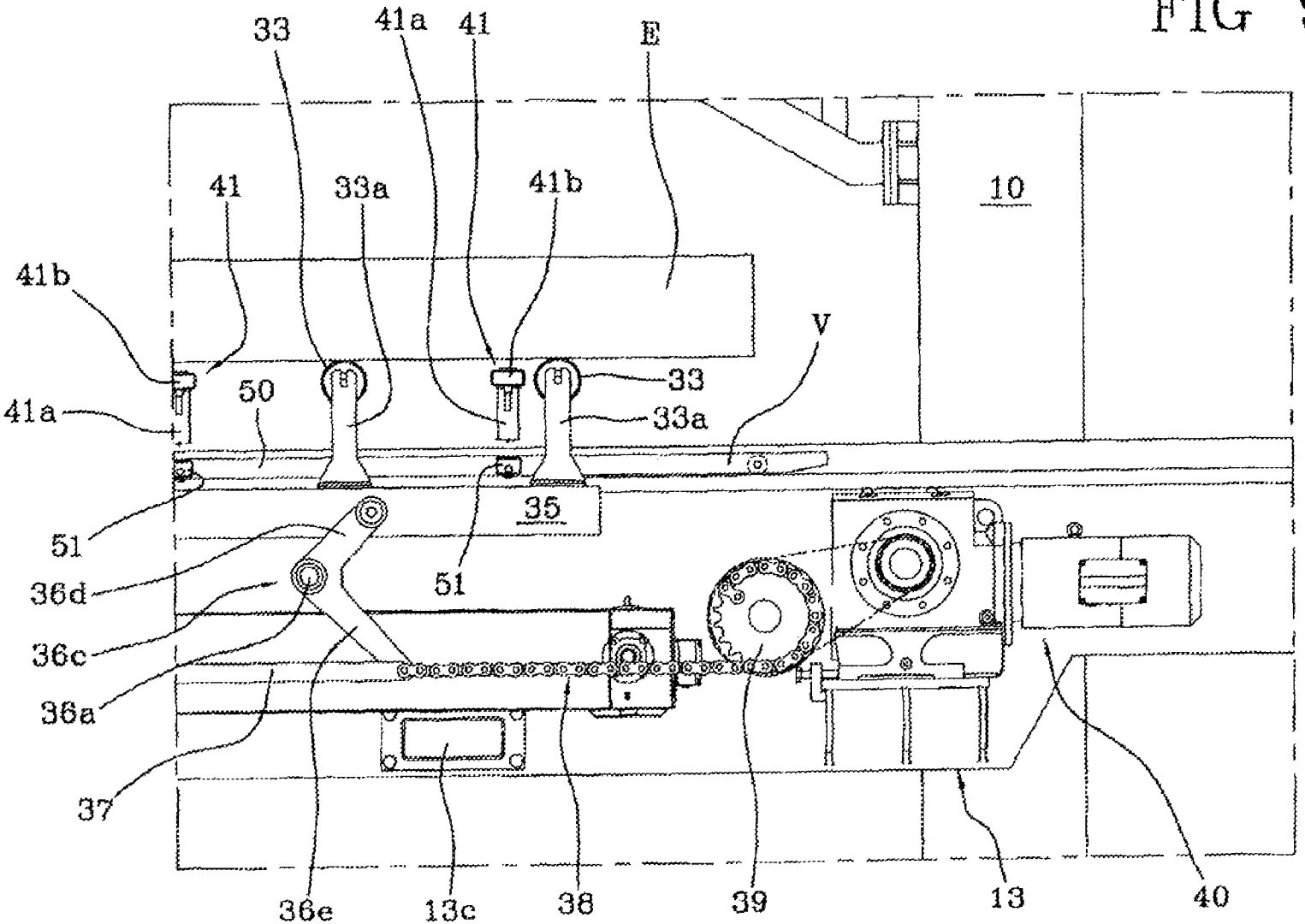
Figure 10:
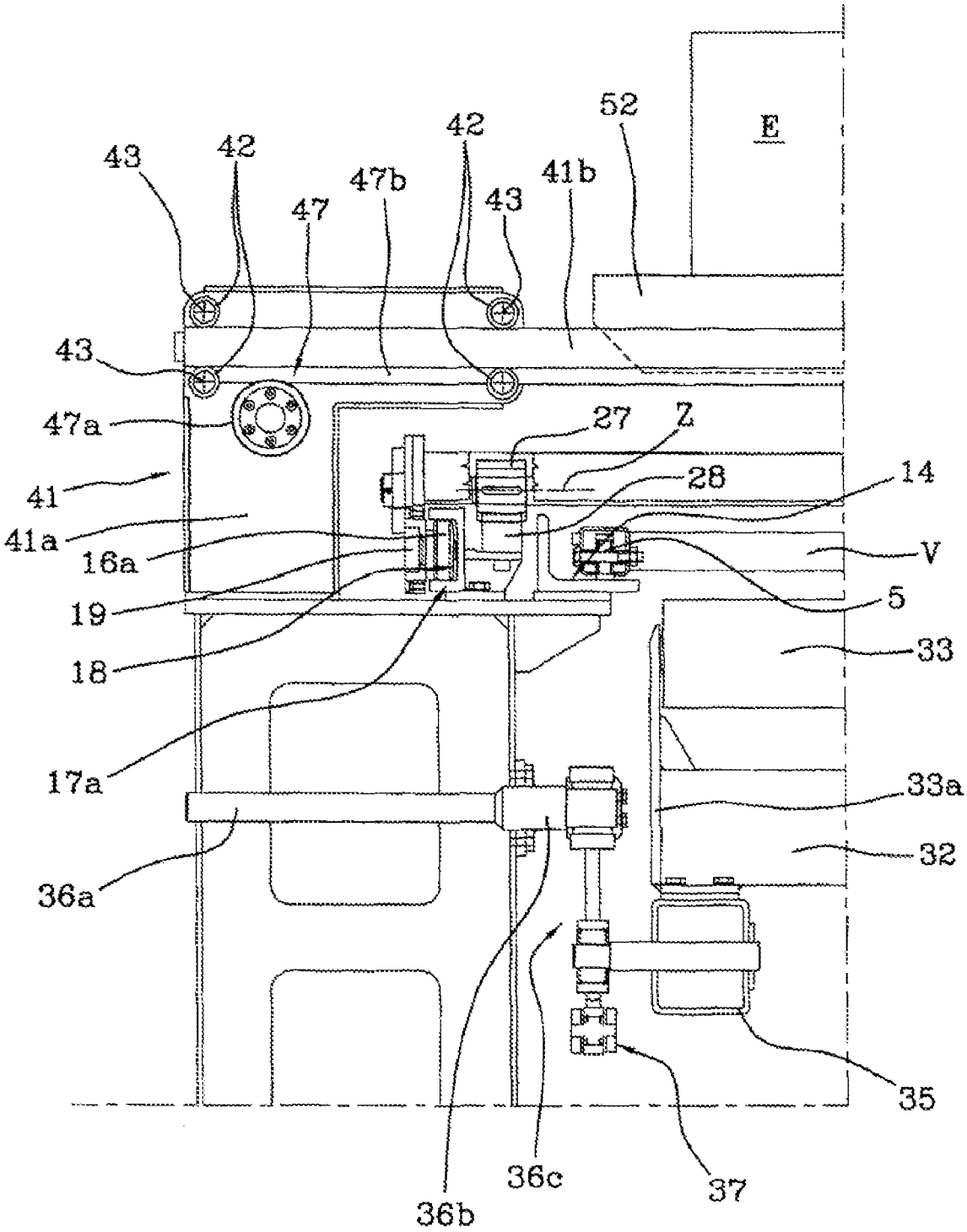
Figure 11:
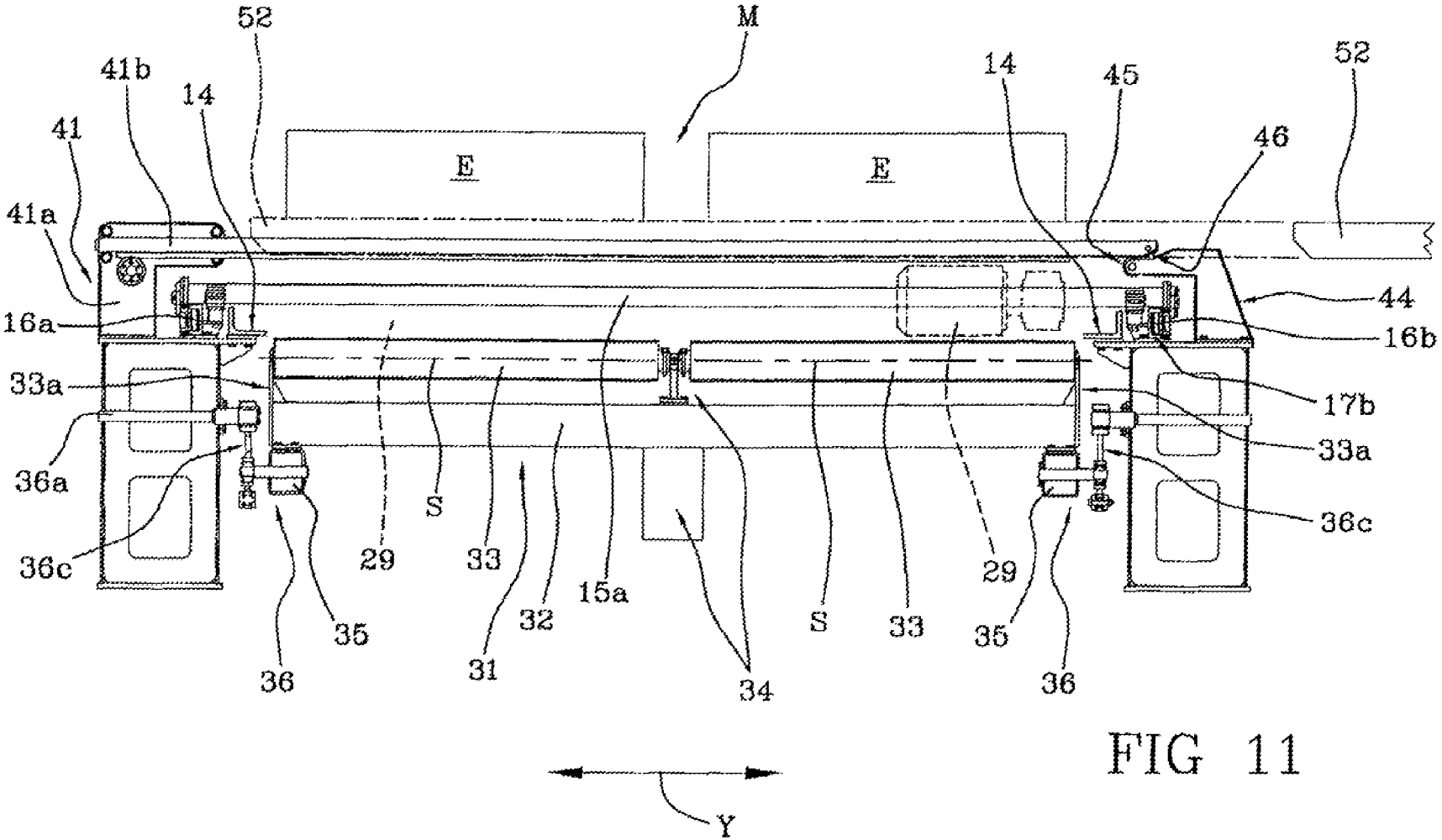
Figure 12:
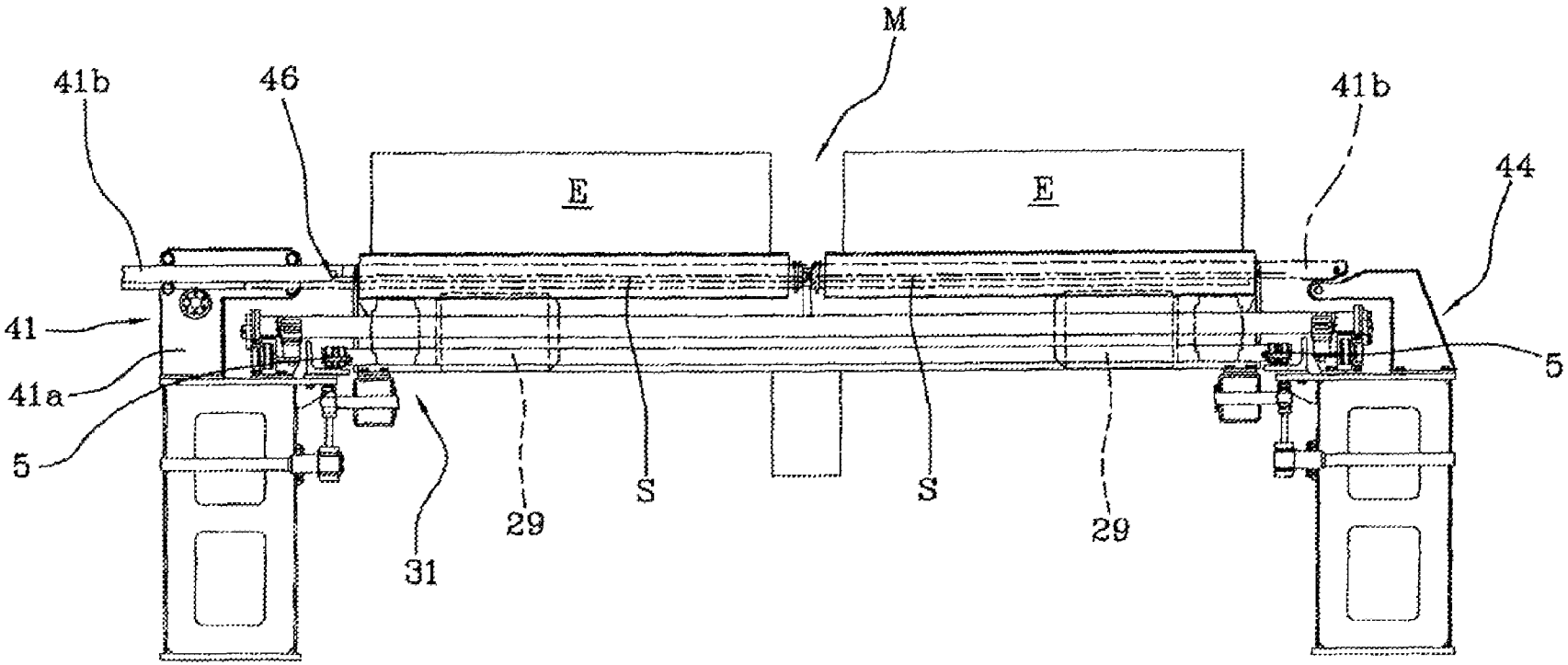
Figure 13:
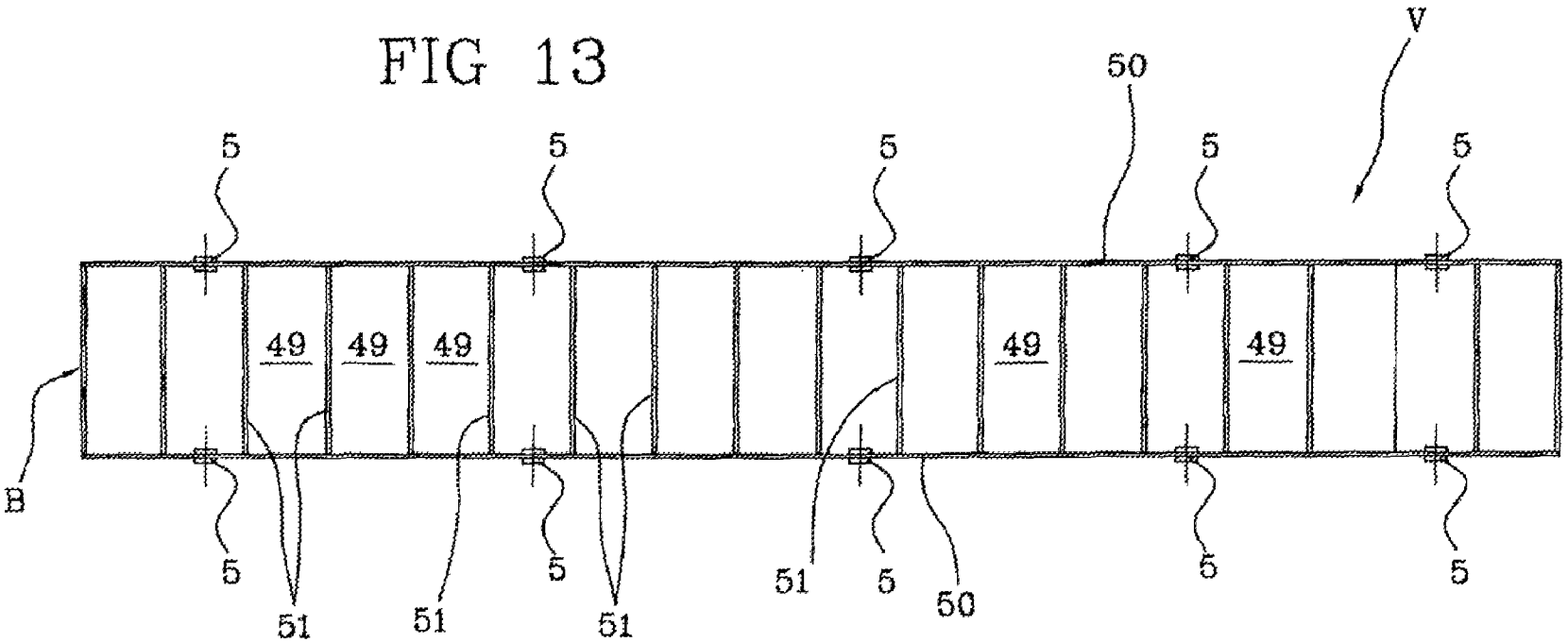

FIG. 8*a* shows a particular of the view of FIG. 8;

FIG. 9 shows a particular of the view of FIG. 6;

FIG. 10 shows a particular in a front view of the second part of FIG. 3 in a further working configuration;

FIG. 11 shows a front view of the second part of FIG. 3 in the first working configuration of FIG. 3;

FIG. 12 shows a front view of the part of FIG. 11 in the fourth working configuration of FIG. 6;

FIG. 13 shows a top view of a third part of the plant according to the invention.

DETAILED DESCRIPTION OF THE INVENTION

With reference to the enclosed figures, a plant for the treatment of metallic elements is generally shown by 1. Such plant finds a particular application in the heat treatment of metallic elements having a prevailing dimension, such as drawn pieces, extrudates or metallic draft products. In the following of this description, the metallic elements will be generally shown by the reference "E".

The plant 1 includes a heating unit 2, which includes at least a chamber 3 thermally insulated towards the external environment and intended for containing one or more metallic elements "E" during a respective heat treatment. Each chamber 3 has a loading opening and an unloading opening. Preferably, such loading and unloading openings coincide in a single access opening, shown by "A1" in the enclosed figures. Such access opening "A1" is associated with a closing articulated door "P1" of a known type and therefore not shown in detail.

In the preferred embodiment shown in FIGS. 1 to 3, the heating unit 2 includes a plurality of chambers 3 placed side by side and/or superimposed therebetween to define a matrix structure. As it can be seen in FIG. 1, the cooling unit is divided, for example, in sixty chambers, placed side by side four by four on fifteen height levels.

In a first embodiment, shown in FIG. 1, the heating unit is divided in at least two portions thermally insulating therebetween 2*a* and 2*b*, separated by a central insulating wall 2*c*, and each one connected with respective independent heaters 4, preferably burners, which are arranged in a lower portion of the heating unit 2, and preferably in two positions opposite therebetween, for generating a heating of the portions 2*a* and 2*b* by exploiting ascending convective movements of the hot air produced by the heater 4 themselves, with a saving in terms of heating efficiency and consequently in terms of energy consumption.

As it can be seen in FIG. 1, each portion 2*a*, 2*b* of the cooling unit includes thirty chambers, placed side by side in pairs on fifteen height levels.

In this way, it is possible to have a different temperature in each portion 2*a*, 2*b* and therefore to simultaneously subject the different metallic elements housed within the two portions to treatments at different temperatures.

Preferably, as it can be seen in FIG. 1, each chamber 3 is able to house at least a pair of metallic elements "E" placed side by side together along a proper longitudinal development. In particular, chambers 3 of the present heating unit 2 show such dimensions to contain a plurality of metallic elements "E" arranged according to a predetermined configuration. Each plurality of metallic elements "E", arranged according to the mentioned configuration, will be called "map" and shown by reference "M" hereinafter. Preferably, each map "M" maintains unchanged its own configuration, namely the arrangement of the metallic elements "E" forming the same, along a whole process of heat treatment within the plant 1.

In other alternative embodiments, not shown, the heating unit can be carried out in a single portion, or a multiplicity of portions thermally insulated therebetween and connected with the respective heater can be foreseen, in order to allow each portion to carry out a heat cycle independent from heat cycles of the other portions.

As it can be seen in FIG. 2, in each chamber 3 a respective support element "V", called "tray", is arranged, suitable for supporting at least a respective map "M" and allowing the introduction of the map "M" within the chamber 3 and a following extraction of the same from the chamber 3 itself.

In the preferred embodiment of the support element "V", shown in FIG. 13, the support element "V" includes a pair of longitudinal, preferably parallel, bars 50, and a plurality of cross bars 51, preferably perpendicular to the longitudinal bars 50 and defining, in co-operations therewith, a plurality of bottom openings 49.

The cross bars 51 are suitable for supporting the maps "M" of metallic elements "E".

Each support element "V", or tray, is movable between a position in which it is at least partly, and preferably completely inserted within the chamber 3, and a second position in which it is at least partly, and preferably completely, extracted from the chamber 3 itself. The support element "V", while inserted in the respective chamber 3, is supported on respective side guides 53 (not shown in detail in the figures as of a per se conventional type) arranged on the sides of the respective chambers 3, in correspondence with said longitudinal bars 50.

Advantageously, each support element "V" is equipped with a plurality of rolling elements 5, which preferably include a plurality of wheels or other sliding elements suitable for the purpose, carried by the support element "V" and rotatable with respect to the same around respective axes of rotation perpendicular to said first "X1" and second "X2" advancing directions of the maps "M".

Such rolling elements 5 are advantageously interposed between the longitudinal bars 50 of the support elements "V" and the respective side guides 53 for allowing the sliding of the support elements "V" along an advancing path of the map "M" from and towards the access opening "A1" of the chamber 3, by minimizing the frictions and allowing a partial, or complete, extraction of the tray from the chamber 3 itself.

It must be specified that the support element "V" is normally inserted within the respective chamber 3, and is extracted from the respective chamber 3 exclusively for receiving maps "M" to be subjected to a heat treatment, or for allowing a withdrawal from the chamber 3 of maps "M" already treated. In other words, the support element "V" is immediately reinserted in the chamber 3 following to the receiving, or the discharging, of the maps "M", and it does not come with the same during further treatment or transport steps within the plant 1, and therefore it always remains in temperature by minimizing energy dissipations.

The plant 1 further includes a cooling unit 6, which is operating on maps "M" previously thermally treated within the heating unit 2, in order to arrange a cooling cycle of the same. Preferably, the cooling unit 6 shows a structure completely similar with the heating unit 2, and therefore it includes a plurality of spaces 7 arranged according to a matrix configuration and each space 7 showing a respective access opening "A2" for the loading and the unloading. Preferably, the cooling unit 6 is further arranged in a position faced to the heating unit 2, such that the openings "A1" of chambers 3 are faced to the openings of the spaces 7 and preferably such that the maps "M" are fed when entering and/or exiting with respect to the chambers 3 along a first direction "X1" parallel with a second advancing direction "X2" of the maps entering and/or exiting with respect to the spaces 7.

Likewise to what previously seen, also each space 7 is associated with a support element "V", or tray, which is movable between a position in which it is at least partly, and preferably completely inserted within the space 7, and a second position in which it is at least partly, and preferably completely, extracted from the space 7 itself. As the heating unit 2 and the cooling unit 6 have the same supporting structure, the support elements "V" associated with the spaces 7 of the cooling unit 6 show the same features of the support elements "V" associated with the heating unit 2, and are subject to the same displacement steps already previously described for the heating unit 2 itself.

Amongst the heating unit 2 and the cooling unit 6, a manoeuvring area is arranged, which is engaged by a displacer 8. The latter is operably working on the heating unit 2, and also on the cooling unit 6, for arranging maps "M" for the feeding to the mentioned heating 2 and cooling 6 units, and for withdrawing the mentioned maps "M" when the heat treatment is ended.

A displacer 8 includes a overhead travelling crane 9, movable at least according to a translation motion which allows it to displace by covering the entire cross space of the heating unit 2 and the cooling unit 6. In detail, the overhead travelling crane 9 is movable along a cross translation direction "Y", preferably perpendicular to said first "X1" and second "X2" advancing directions of the maps "M" entering and/or exiting from the chambers 3 or the spaces 7, respectively.

According to the embodiment shown in the enclosed figures, and clearly visible in FIGS. 3 to 7, the overhead travelling crane 9 includes four vertical posts 10, only two of which are visible, arranged at the vertex of a rectangle. Each post 10 has, at the bottom, one or more respective rolling elements, preferably wheels, having the function of guiding the post 10 along the mentioned translation direction "Y".

Posts 10 are firmly connected together by at least a couple of first beams 11 having a network structure, parallel therebetween and preferably arranged perpendicular to the mentioned translation direction of the overhead travelling crane 9, and a plurality of first stiffening elements 12, which stably connect the first two beams 11 for defining a mutual stable positioning of the four posts 10. Preferably, as it is shown in the enclosed figures, two couple of first beams 11 are foreseen, a couple of which acting on lower portions of the posts 10, and the other couple acting on the upper portions of the posts 10.

The overhead travelling crane 9 further includes a lift 13, which slidably engages the four posts and is movable in a vertical direction under the action of a respective actuator of a known type and therefore not shown. The actuator means of the lift 13, for example, can find support on a couple of crossbars "T", each of which is associated with upper ends of a couple of posts 10 and preferably aligned along the translation direction "Y" of the overhead travelling crane 9.

The lift 13 includes a stiff structure 13*a* of a quadrangular shape, which is slidably engaged with the four posts for supporting, and vertically displacing by lifting or lowering a respective map "M" so as to position them in correspondence with a chamber 3 or a space 7. The stiff structure 13*a* presents at least a first guide surface 14, and preferably two guide surfaces 14 parallel and opposite one to the other, which can be slidably engaged by a support element "V" for holding the support element "V" itself while it is in the respective second position withdrawn from the chamber 3. The mentioned guide surfaces 14 develop themselves parallelly with said first advancing "X1" and second advancing "X2" directions of the maps "M" respectively entering and/or exiting the chambers 3 or the spaces 7. In the preferred embodiment, the stiff quadrangular structure 13*a* includes a couple of second beams 13*b* parallel one to the other and arranged in parallel with the mentioned first "X1" and second "X2" advancing directions of the maps "M". Preferably, moreover, the stiff structure 13*a* includes two second stiffening elements 13*c*, perpendicular to the second beams 13*b* and stiffly connected thereto for imparting a closed rectangular conformation to the stiff structure 13*a*. Second beams 13*b* and second stiffening elements 13*c* internally define a manoeuvring space 13*d* which, as it will be described below, is engaged during an operative working of the plant 1 for allowing the displacing of the maps "M". In the preferred and shown embodiment, the mentioned guide surfaces 14 are made on the second beams 13*b*.

In particular, the support element "V" slides on the first guide surfaces 14 by the mentioned rolling elements 5.

The displacer, and particularly the overhead travelling crane 9, further includes a conveyor 15, carried by the lift 13 and acting on maps "M" for transferring the same entering and/or exiting to/from the chambers 3, and preferably also to the spaces 7. Advantageously, the conveyor 15 is directly operating on the supporting elements "V" for displacing the maps "M", carried by the support elements "V" entering and/or exiting with respect to chambers 3 and spaces 7, according to the working details which will be explained in the following of the present description.

In detail, the conveyor 15 includes a gripping element 15*a*, slidably engaged on the lift 13 and movable along a transport direction "W" parallel with the mentioned first "X1" and second "X2" advancing direction of the maps "M". In particular, the gripping element 15*a* is movable, in a back and forth movement, between an advanced position, in which it is arranged in proximity of the access opening "A1" of a chamber 3 for gripping a support element "V", and a second backward position, in which it is removed from such access opening "A1" for maintaining the support element "V" in a partly, preferably completely extracted position from the chamber 3. Preferably, the gripping element 15*a* acts in a completely similar way on the support elements "V" associated with the spaces 7 of the cooling unit 6.

In the embodiment shown in FIG. 8*a*, the gripping element 15*a* includes a carriage 16 having a couple of first wheels 16*a* and a couple of second wheels 16*b*, opposite to the first ones 16*a*, and it is driven by respective second guide surfaces 17 of the displacer 8. The mentioned wheels 16*a*, 16*b* rotate around respective horizontal axes of rotation.

As it can be seen in FIGS. 10 to 12, the mentioned second guide surfaces 17 include, in detail, a first groove 17*a* and a second groove 17*b*, carried out within "C"-shaped draw pieces and placed on opposite portions of the mentioned stiff structure 13*a*. Each groove 17*a*, 17*b* is developing along the mentioned transport direction "W", and defines a respective seat 18 which can be laterally engaged by a respective pair of wheels 16*a*, 16*b* of the carriage 16. Moreover, the pairs of wheels 16*a*, 16*b* are supported in cantilever with respect to the carriage 16 by corresponding brackets 19 and are protruding towards an internal part of the carriage 16 itself within the mentioned seats 18 so as to prevent detachment and/or slanting movements of the carriage 16 with respect to the stiff structure 13*a*, and therefore with respect to the lift 13.

The gripping element 15*a* further includes a first arm 20, preferably also a second arm 21 opposite to the first arm 20, each of which can be stably engaged with a corresponding end portion "B" of a support element "V". In particular, as it can be seen in FIG. 8*a*, each arm 20, 21 respectively shows a first end 20*a*, 21*a* hinged to the carriage 16 and a second end 20*b*, 21*b* opposite to the first one 20*a*, 21*a*, defining a respective hooking portion 22. This latter includes a substantially semicircular seat, while the end portion "B" of the support element "V" has a cylindrical conformation with a circular cross-section. Therefore, the hooking portion 22 is substantially countershaped to the end portion "B" of the support element "V", and it is able to stably and removably associate with the same for defining a stable gripping of the support element "V" to the gripping element 15*a*.

Each arm 20, 21 is operably movable between an engagement position, preferably lowered, in which it is stably associated with the mentioned corresponding end portion "B" of the support element "V", as shown by the solid line in FIG. 8*a*, and a disengagement position, preferably lifted, in which it is disengaged from such end portion "B", as shown by a dotted line in FIG. 8*a*. The gripping element 15*a* is associated with a respective actuator 23, which includes a pair of linear actuators 24, preferably hydraulic or pneumatic pistons, each of which is operating between the carriage 16 and a respective arm 20, 21 for driving this latter between the respective engagement and disengagement positions. Each arm shows, in fact, an appendix 25, which is connected by a hinge 26 to an active end of the respective linear actuator 24, such that a travel of the linear actuator 24 itself generates a rotation of the arm 20, 21 between the engagement and disengagement positions, and vice versa. In an alternative embodiment, the two arms 20, 21 are connected together to a single linear actuator 24.

The gripping element 15*a* further includes a couple of pinions 27, arranged on opposite sides of the carriage 16 and each of which is operating through engagement on a respective rack 28 stably associated with a stiff structure 13*a*, and in particular to second beams 13*b*. Pinions 27, which preferably rotate around a same axis of rotation "Z" perpendicular to the transport direction "W" have the function to impart an advancing movement to the carriage 16 along the mentioned transport direction "W". For this purpose, the mentioned actuator 23 of the gripping elements also includes an electric motor 29, carried by the carriage 16 itself and connected with pinions 27 for transmitting to the same a driving power capable of translating the gripping element 15*a* along the transport direction "W".

The displacer 8 further includes a lifter 30, preferably supported by the lift 13 and operating on the metallic elements "E" of the maps "M" between an operating position, in which they engage the metallic elements "E" at least for lifting the same at least with respect to the support element "V" when it is in the second position, and a resting position, in which they are not operating on the metallic elements "E". The lifter 30 is operating through the mentioned manoeuvring space 13*d*, and in space portions standing above such manoeuvring space 13*d*.

In the embodiment shown in FIGS. 3 to 8 and 9 to 12, the lifter 30 includes a plurality of pushing elements 31, which are movable according to a vertical direction for intercepting and lifting and/or lowering a map "M" with respect to a respective support element "V", when this latter is in the respective second position.

The pushing elements 31 are arranged along a row parallel with the mentioned transport direction "W", such that at least a part of the pushing elements 31 of a same row can be engaged to a same metallic element "E" of a map "M", such that the metallic element "E" can be stably supported in a plurality of points. In the preferred embodiment shown in FIGS. 11 and 12, each pushing element 31 includes a horizontally arranged manoeuvring bar 32, having at the top at least a support roll 33, preferably two aligned together, namely rotatable with respect to a same axis of rotation "S". Such axis of rotation is horizontal and perpendicular with the mentioned first "X1" and second "X2" advancing directions of the maps "M" and, preferably, the manoeuvring bars 32 develop parallel with the axes of rotation "S" of the support rollers 33.

Support rolls 33 are held in position by supports 33*a* integral with the manoeuvring bars 32, and they act on a lower portion of the metallic elements "E", defining a plurality of support points for the same. Furthermore, support rollers 33 are connected with the respective actuator 34, which operates with a controlled rotation, the support rollers 33 such that, when these latter support one or more metallic elements "E", such metallic elements "E" can be translated along the mentioned advancing direction of the maps "M" for being transferred, for example, to a withdrawer, not shown, under the action of said actuator 34 which rotates the support rollers 33 around its own axis "5". In the preferred and shown embodiment, the actuator 34 of the support rollers 33 includes an electric motor, supported by a respective manoeuvring bar 32 and connected with a chain transmission which acts on one or more shafts integral with the support rollers 33, for making them rotate.

According to the views of FIGS. 8 and 9, the lifter 30 further includes a pair of connecting elements 35, only one of which is visible, which are parallel together and are stiffly connected with the manoeuvring bars 32 for rendering them integral together.

Connecting elements 35 develop parallel to the first beams 11 and are connected with the respective actuator for receiving a lifting mechanical action. In particular, as it is visible from FIGS. 3 to 8 and in FIG. 9, the actuator of the connecting elements 35 includes a plurality of lever connections 36, operating between the stiff structure 13*a* and the two connecting elements 35, and displaced along a whole length of the two connecting elements 35 for distributing the mentioned lifting action.

Each lever connections 36 includes a shaft 36*a*, rotatably supported by a second beam 13*b* of the stiff structure 13*a* and having one end 36*b* protruding from said second beam 13*b*, to which a "L"-shaped lever 36*c* is firmly fixed. The "L"-shaped lever 36*c* is fixed to the shaft 36*b* in correspondence with one own elbow shaped central portion, and determines a first lever arm 36*d* and a second lever arm 36*e*, perpendicular one to the other and joined by said elbow portion.

The first lever arm 36*d* is hinged, at a free end, to the connecting element 35, while the second lever arm 36*e* is hinged to a tie rod 37. Preferably, the tie rod 37 is substantially extending for a whole development of the connecting element 35, and is connected with the second lever arms 36*e* of all the lever connections 36 associated with the connecting element 35. The tie rod 37, at one own end, is connected with one end of a chain section 38, which, in correspondence with the other own end, is partly wound on a gear wheel 39 connected with a respective electric motor 40. Following to a winding movement of the chain section 38 on the gear wheel 39, caused by a rotation of this latter, the tie rod 37 is moved approaching to the gear wheel 39 causing a rotation of the levers 36*c* about the respective shafts 36*a*. Such rotation of the levers 36*c* causes a lifting of the first lever arms 36*d*, which transmit a lifting motion to the connecting element 35.

Following to the rotation of the levers 36*c*, the tie rod 37 is also subjected to a vertical displacement, in particular downwards. Such displacement is absorbed by the chain section 38, which can consequently deform itself by maintaining a pulling action on the tie rod 37.

The displacer 8 further includes a holder 41 of the metallic elements "E", preferably carried by the rigid structure 13*a*. Such holder 41 is operating on the maps "M" for maintaining them in a lifted position with respect to the lifter 30, and with respect to the support element "V" when the same is in its own second position. In the preferred embodiment shown in detail in FIGS. 9 to 12, the holder 41 includes a plurality of support heads 41*a*, and a plurality of parallel brackets 41*b*, placed side by side and each associated with a respective support head 41*a*. Support heads 41*a* are mounted in a stable position on second beams 13*b* of the stiff structure 13*a*, preferably along an entire dimension of the support element "V" on the displacer 8 when the support element "V" is in the respective second position, namely in an extracted position from the chamber 3 or the space 7. Each bracket 41*b* is arranged according to a horizontal plane, for defining a support surface of the maps "M", and shows a prevailing direction with a cross development, preferably perpendicular to the transport direction "W" of the maps "M".

Each bracket 41*b* is further slidably movable, with respect to the support head 41*a*, along one own sliding direction between an operating position, in which it extends on the lifter 30, and in particular on said manoeuvring space 13*d*, and a resting position, in which it is retracted with respect to said operating position for disengaging a work space above the lifter 30.

According to the views shown in FIGS. 9 to 12, support heads 41*a* include two pairs of displacing rollers 42 of said brackets 41*b*. Such displacing rollers 42 are rotatable relative to the respective axes of rotation 43 perpendicular to the prevailing development direction of the brackets. Furthermore, displacing rollers 42 of each pair are vertically aligned with one another, and are spaced therebetween by a space which is a little more thicker than the respective bracket 42 for allowing the same to be slidably inserted amongst said displacing rollers 42. The two pairs of displacing rollers 42 are arranged one after the other along a translation direction of the respective bracket 41*b*, for sliding the respective bracket 41*b* on the two pairs of displacing rollers 42, such that these latter define a cantilevered support of the brackets 41*b* while the same slide between the respective operating position and the respective resting position, and vice versa.

From the opposite part relative to the support heads 41*a*, namely on the second beam 13*b* opposite to the one on which support heads 41*a* are fixed, backing heads 44 are foreseen, each of which is arranged in an aligned position on the sliding direction of the respective bracket 41*b*. In detail, as it is visible in FIGS. 11 and 12, each backing head 44 includes a backing roller 45, defining at the top a support for the respective bracket 41*b* when the same is in its own operating position. In such operating position, in fact, brackets 41*b* support maps "M" waiting for being loaded on the respective support element "V", as it will be described below, and therefore it results opportune to provide an additional support to the brackets 41*b* which, without such support, would work as cantilever under the action of strong loads, with evident yielding risks.

To facilitate the support of the brackets 41*b* with the support rollers 45 approaching said respective operating positions, each bracket 41*b* shows a front slanted guard surface 46, which is gradually engaged with the respective support rollers 45. In this way, jamming risks in the translation of the brackets 41*b* during their displacement between the resting position and the operating position are reduced.

Each bracket 41*b* is operated along the respective sliding direction by a rack and pinion system 47, as shown in FIG. 10. In detail, each support head 41*a* includes a respective gear wheel 47*a*, rotatable about a horizontal axis perpendicular to the translation direction of the respective bracket 41*b*, and a teeth system 47*b*, made on a rectilinear, preferably lower surface of the bracket 41*b*. The gear 47*a*, connected with a respective motor, is engaged with the teeth system 47*b* so as to generate, following to a rotation of the gear wheel 47*a*, a translation of the teeth system 47*b* and therefore of the bracket 41*b*. The teeth system 47*b*, which is preferably a rack fixed below the bracket 41*b*, is arranged such not to interfere with the displacement rollers 42 of the bracket 41*b*, for example such teeth 47*b* is fixed to the bracket 41*b* externally to a rolling path of the displacement rollers 42 on the bracket 41*b* itself.

Brackets 41*b*, being placed side by side, define a sequence of respective interspaces 48, each of which is laterally delimited by a couple of brackets 41*b*. Advantageously, brackets 41*b* are spaced so as to allow said interspaces 48 to be engaged by respective support rollers 33 of the lifter 30 while these latter are in a lifted position. Therefore, in such configuration the displacer 30, and in particular the support rollers 33, does not interfere with the brackets 41*b*.

On the other hand, also the support element "V" presents respective bottom openings 49, which can be engaged by said support rollers 33 during a respective lifting action. It has to be remembered that, according to the preferred embodiment of the support element "V", shown in FIG. 13, the support element "V" includes a couple of longitudinal, preferably parallel, bars 50 and a plurality of cross bars 51, preferably perpendicular to the longitudinal bars 50 and defining, in co-operations therewith, a plurality of bottom openings 49.

In such configuration, the support element 49 allows, while it is in the respective second position, a crossing of said bottom openings 49 from the support rollers 33 during a lifting action of the same. Support rollers 33, therefore, are able to engage metallic elements "E" initially abutted on said longitudinal 50 and cross 51 bars, and lift them with respect to the support "V" without interfering with this latter. Likewise, in a reverse action, the support rollers 33 can be lowered through the bottom openings 49, and abut metallic elements "E" on said longitudinal 50 and cross 51 bars of the support element "V".

For this purpose, cross bars 51 are spaced therebetween such not to interfere with the encumbrance of the support rollers 33 during a displacement of the same in lifting or lowering actions.

A preferred functioning of the plant according to the invention is described hereinafter, beginning from a starting configuration in which support elements "V" are in the respective first positions, namely inserted within the respective chambers 3 or the respective spaces 7, the support rollers 33 are in a lowered position, while the brackets are in the respective operating position, that is they are extending above the lifter 30 and are supported also by the respective backing heads 44.

Starting from such configuration, metallic elements "E" are fed to the plant 1 in form of maps "M" having a predetermined configuration.

In particular, the maps are initially supported by combs 52, which are preferably parallel to the brackets 41*b*. Such combs 52, which are spaced therebetween such to intercalate themselves with the respective brackets 41*b* without interfering with the same, are carried to a height which is a little more than the height of the brackets 41*b*, and are advanced in parallel with the brackets 41*b* for bringing the maps "M" above said brackets 41*b*, by reaching a configuration shown in FIGS. 3, 8, 10 and, by a dotted line, in FIG. 11.

Figure 4:
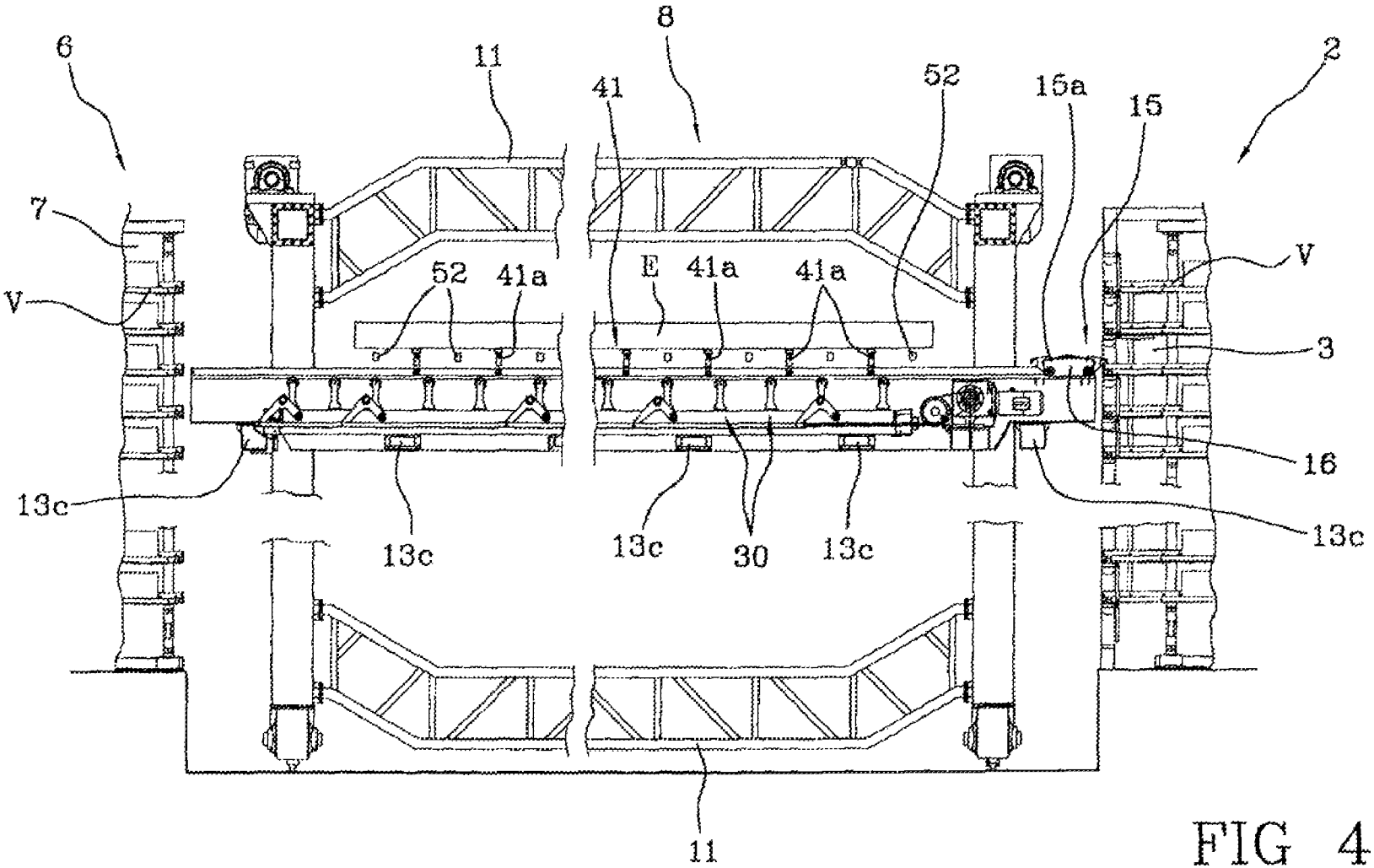
FIG. 4 shows a side view of the part of FIG. 3, in a second working configuration.

Successively, brackets 41*b* are lifted and, being intercalated to the combs 52, withdraw the maps "M" without interfering with the combs 52 themselves, reaching a position shown in FIG. 4. The lifting action of the brackets 41*b* takes place by raising the lift 13 under the action of said respective actuator of a known type, therefore not shown.

It follows that the combs 52 can be removed from the displacer 8 according to what shown by a solid line in FIG. 11. It follows that the lift 13 can be operated for bringing the second guide surfaces 17 at such a height that it is possible to receive the support element "V" associated with a predetermined chamber 3, in which the map "M" can be inserted for subjecting it to a heat treatment. Such operation can be associated with a translation of the overhead travelling crane 9 along the respective translation direction Y in order to reach said predetermined chamber 3.

At this time, an opening operation of the respective closing door "P1" takes place through a pusher of a known type and therefore not described in detail, for the purpose of rendering accessible the respective access opening "A1" and allowing the withdrawal or the introduction of the map with the respective support element "V", as it can be seen for example in FIGS. 3 and 4.

The closing door "P1" is then brought back in a closing position, for example through resilient means for drawing back.

Figure 5:
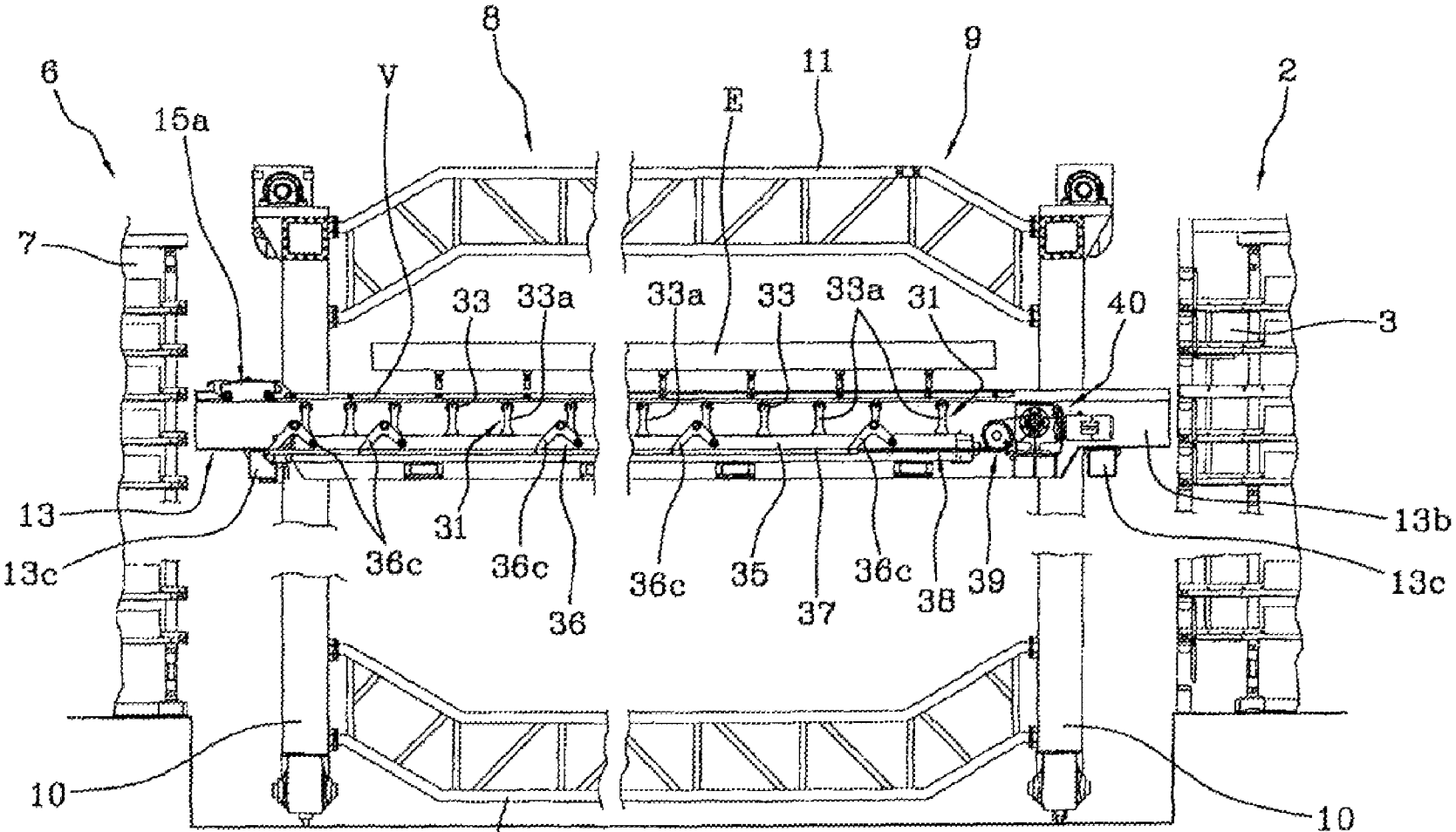
FIG. 5 shows a side view of the part of FIG. 3, in a third working configuration.

FIGS. 5 and 10 show that, successively, the support element "V" is transferred on the lift 13 and in particular is made to slide on said first guide surface 14 until said second position under a gripping and transport action of the gripping element 15*a*.

Support rollers 33 are then lifted, passing through the manoeuvring space 13*d* and the bottom openings 49 of the support element "V", until they engage the maps "M" supported by the brackets 41*b*, and from here further lifted for releasing the maps "M" from the brackets 41*b*, reaching the position shown in the different views of FIGS. 6, 9 and 12. At this time, brackets 41 are retracted by reaching the respective resting position, as shown by a solid line in FIG. 12.

Figure 7:
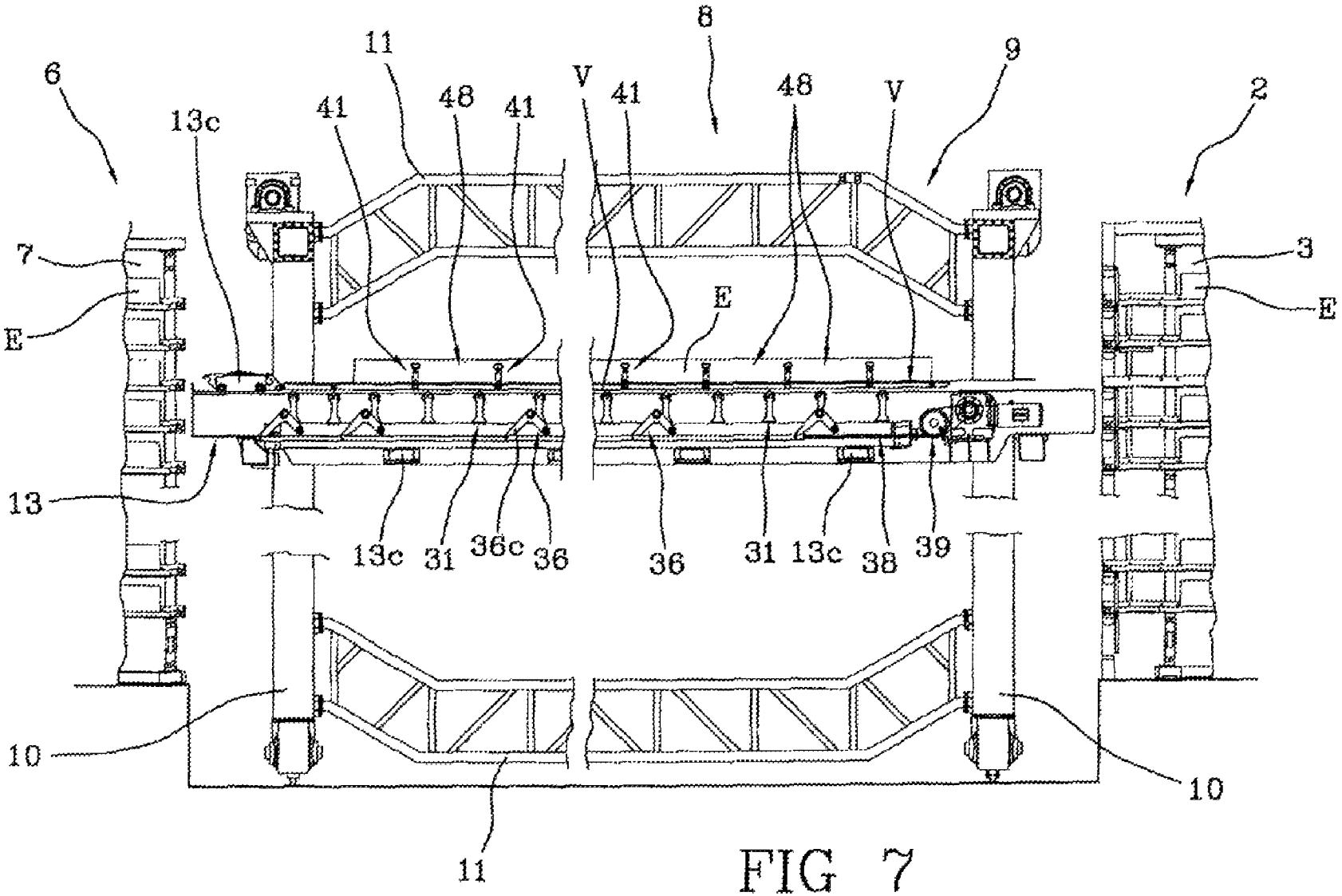
FIG. 7 shows a side view of the part of FIG. 3, in a fifth working configuration.

A following lowering of the support rollers 33 cause the maps to abut to the support element "V" and particularly to the longitudinal 50 and cross 51 bars. A following lowering of the support rollers 33 cause a disengagement of these latter from the maps "M", which are therefore completely supported by the support element "V", as shown in FIG. 7.

The gripping element 15*a* can therefore transfer the support element "V" with the maps "M" within the chamber, then disengage itself from the same and allow a closing of the chamber for starting the heat treatment of the map "M".

When the heat treatment is ended, the chamber 3 is made accessible by opening the respective closing door "P1" by the pusher and the gripping element 15*a* is engaged with the support element "V" associated with such chamber 3 and supporting the treated maps "M", by extracting it from the chamber 3 itself in order to bring it in the respective second position, in which it is supported by the second guide surfaces 17 of the displacer 8.

The maps "M" are therefore arranged for a transfer thereof in a respective space 7 of the cooling unit 6.

In particular, following to the positioning of the support element "V" on the displacer 8, support rollers 33 are operated which, by passing through the bottom openings 49 of the support element "V", are lifted for intercepting the maps "M" and transfer them at a level higher than the support surface defined by the brackets 41*b*. At this time, the brackets 41*b* are displaced until they engage the respective backing heads 44, correspondingly with the respective operating positions of the brackets 41*b* themselves.

Support rollers 33 are then lowered for abutting the map "M" to the brackets 41*b*, and further lowered for disengaging themselves from the map "M" itself. In such position, the map "M" is exclusively supported by the brackets 41*b*, and in this case the gripping element 15*a* pushes the support element "V" within the respective chamber 3.

Subsequently, the overhead travelling crane 9 is moved for arranging the lift in correspondence with a respective space 7 of the cooling unit 6. During such movement, the overhead travelling crane 9 moves along the respective translation direction "Y" and the lift 13 is lifted or lowered until it is arranged in correspondence of said space 7. As the cooling unit 7 is placed in an opposite position with respect to the heating unit 2 relative to the displacer 8, it is evident the reason of the presence of the second arm 21 of the gripping element 15*a*. In fact, the gripping element 15, after having previously transported the support element "V" within the respective chamber 3, slides on said first guide surfaces 14 until it reaches an opposite portion of the lift 13, thus arranging in proximity of the opening "A2" of said space 7. In such configuration, the gripping element 15*a* grips the support element "V" inserted within such space 7 and extracts the same until it brings it in the respective second position, in which it is supported by the second guide surfaces 17 of the displacer 8.

Starting from this position, a transfer process of the maps "M" from the brackets 41*b* to the support element "V" takes place, completely similar to what has been described for the corresponding transfer process of the maps "M" before the introduction in the respective chamber 3. Therefore, the description of the functioning of the plant 1 will follow starting from a position in which the map "M" has ended its cooling treatment and has reached a position in which it is supported by the brackets 41*b*, and also the support element "V" has been returned within the respective space 7.

Following this, the overhead travelling crane 9 and the lift 13 are moved so as to bring themselves in correspondence with the withdrawer of the maps "M", not shown in detail in the enclosed figures.

The withdrawer can advantageously include transport idlers having a plurality of "idler" free rollers, without operating mechanisms, on which the cooled maps of metallic elements are abutted and advanced until the following treatment or packing steps.

Such idlers can advantageously be foreseen in correspondence with a pair of lower cells of the cooling unit.

In such position, support rollers 33 are lifted until they disengage the map "M" from the brackets 41*b* and are therefore operated for advancing the map "M" towards said withdrawer, by defining an advancing path of the maps "M".

When the operation is completed, the displacer 8 can start again a new operation cycle on another map "M".

The present invention attains the proposed aims, by overcoming the drawbacks of the known art.

In fact, the movement of the maps by external means outside the chambers allows to reduce the wear and the deterioration of the means arranged for the displacement of the maps themselves, as such means, according to the present invention, does not operate contacting high temperatures typical of the heat treatments carried out in the chambers of the heating unit, but they operate at room temperature.

Furthermore, the support elements of the maps are usually located within the chambers of the heating unit and the spaces of the cooling unit, and are withdrawn only for a short time required for the loading of the maps thereon or for their unloading. It follows that the hot support elements, following to the heat treatments in the heating unit, are not subjected to a complete air cooling but are introduced again in the respective chambers after a short time, with an evident energy saving with respect to the known systems, in which containment baskets of the metallic elements followed, on the contrary, the metallic elements themselves in each plant station, by dissipating in air the heat energy gained during the heat treatment in a furnace.

Moreover, the present invention attains further important advantages.

In fact, the presence of a plurality of chambers and spaces allows the displacer to carry out transport operations of maps while other maps are subjected to the respective heat treatment of heating or cooling, therefore operating a treatment in parallel of the maps themselves. A plant thus structured allows a remarkable working flexibility, as it is possible to change the length of heat treatments to which different maps are subjected, and furthermore it is not necessary to wait until the end of the heat treatment of a map before starting the treatment of the following map.

The invention claimed is:

1. A method for heat treatment of metallic elements, including the steps of:

arranging at least one metallic element (E) to be subjected to a heat treatment;

arranging a containment chamber (3) for said metallic element (E), said chamber (3) including at least an access opening (A1);

heating said chamber (3) for bringing or maintaining the same at a predetermined temperature;

transporting the metallic element (E) exiting or entering with respect to said chamber (3) by way of transporting a support element (V), loaded with said metallic element (E), exiting or entering with respect to said chamber (3) by acting from the outside of the chamber (3); wherein said step of transporting the metallic element (E) exiting or entering with respect to said chamber (3) includes the steps of:

arranging a support element (V) for at least one metallic element (E) in a second position in which it is at least partly extracted form said respective chamber (3);

positioning at least a metallic element (E) on the support element (V);

moving the support element (V), loaded with said metallic element (E), into a first position, in which it is at least partly inserted within said respective chamber (3); wherein the step of positioning said metallic element (E) on the support element (V) includes the steps of:

holding the metallic elements (E) at a predetermined height from a maneuvering area (13*d*);

positioning said support element (V) in the second position in proximity of the maneuvering area (13*d*) and below said metallic element (E);

lowering said metallic element (E) and abutting it on the support element (V), and wherein in the step of transporting the support element (V), loaded with said metallic element (E), exiting or entering with respect to said chamber (3), the support element (V) moves along a first guide surface (14) defining a transport direction (W) of said support element (V), and a gripping element (15*a*) movably and stably engages the support element (V), and slides along a pair of second guide surfaces (17), parallel to said first guide surface (14), for moving the support element (V).

2. The method according to claim 1, wherein said step of transporting the metallic element (E) exiting or entering with respect to said chamber (3) takes place with a conveyor (15) exclusively positioned outside said chamber (3).

3. The method according to claim 1, wherein said step of transporting the support element (V) includes a step of applying a force to an end portion (B) of the support element (V) for moving said support element (V) exiting or entering with respect to said chamber (3).

4. The method according to claim 1, wherein it includes a step of collecting said metallic element (E) from the support element (V), said step including the steps of:

positioning the support element (V), loaded with said metallic element (E), in the second position in correspondence with the maneuvering area (13*d*);

lifting the metallic element (E) by disengaging the same from the support element (V) and bringing the metallic element (E) at a predetermined height from the maneuvering area (13*d*);

stably holding the metallic element (E) at a predetermined height with respect to the maneuvering area (13*d*).

5. The method according to claim 4, wherein said step of collecting said metallic element (E) from the support element (V) includes, subsequently to the step of holding the metallic element (E) at a predetermined height, a step of returning the support element (V) within the respective chamber (3).

6. The method according to claim 1, wherein said step of holding the metallic element (E) at a predetermined height with respect to the maneuvering area (13*d*) includes a step of abutting said metallic element (E) on at least a bracket (41*b*) defining a support surface elevated with respect to the maneuvering area (13*d*), wherein the method further includes the steps of lifting said metallic element (E) with respect to the bracket (41*b*) and removing the bracket (41*b*) for allowing the lowering of the metallic element (E).

7. The method according to claim 4, wherein said step of stably holding the metallic element (E) at a predetermined height relative to the maneuvering area (13*d*) includes the steps of, after lifting said metallic element (E) relative to the maneuvering area (13*d*), positioning at least one bracket (41*b*) below the metallic element (E) for defining a support surface elevated relative to the maneuvering area (13*d*), and lowering the metallic element (E) for abutting this latter on said at least one bracket (41*b*).

8. The method according to claim 4, wherein said steps of lowering or lifting said metallic element (E) take place by acting on a lower portion of said metallic element (E) by a lifter (30) operating through said maneuvering area (13*d*).

9. The method according to claim 1, wherein said support element (V) is moved between the first position, in which it is completely inserted within said respective chamber (3), and the second position in which it is completely extracted form said respective chamber (3).

10. The method according to claim 8, wherein in said step of acting on a lower portion of said metallic element (E), at least a portion of the lifter (30) crosses an opening (49) of a bottom of the support element (V), said opening (49) allowing the lifter (30) to engage the metallic elements (E) and lift them with respect to the support element (V).

11. The method according to claim 8, wherein in said steps of lowering or lifting said metallic element (E), a bracket (41*b*) is located at a lower level than a lifting level reached by said lifter (30), for intercepting the metallic elements (E) supported by the lifter (30) during a lowering movement of these latter.

12. The method according to claim 1, wherein in said step of transporting the support element (V), loaded with said metallic element (E), exiting or entering with respect to said chamber (3), a first arm (20) is stably associated, in an engagement position, with a respective end portion (B) of the support element (V), and, in a disengagement position, it is disengaged form the respective end portion (B) of the support element (V), the first arm (20) being rotatably connected to a carriage (16) of the gripping element (15*a*), the carriage sliding along said second guide surfaces (17), and the first arm oscillating with respect to the carriage (16).

13. The method according to claim 8, wherein in said step of lowering or lifting said metallic element (E) each one of a plurality of pushing elements (31) of the lifter (30) moves through a respective bottom opening (49) of said support element (V), the pushing elements (31) being connected together by at least a connection element (35), said connection element (35) being operated by a respective actuator (36) in order to allow a simultaneous displacement of said pushing elements (31) along a lifting or lowering directions.

14. The method according to claim 6, wherein a plurality of said brackets (41*b*), placed side by side and defining a support surface of the metallic elements (E), translates transversally to said transport direction (W) between an operating position, in which they are extending above the maneuvering area (13*d*), and a resting position, in which they are retracted relative to said operating position under the action of the respective actuator, to free a working space above the maneuvering area (13*d*).

15. The method according to claim 7, wherein a plurality of said brackets (41*b*), placed side by side and defining a support surface of the metallic elements (E), translates transversally to said transport direction (W) between an operating position, in which they are extending above the maneuvering area (13*d*), and a resting position, in which they are retracted relative to said operating position under the action of the respective actuator, to free a working space above the maneuvering area (13*d*).

16. The method according to claim 13, wherein in said step of lowering or lifting said metallic element (E), said pushing elements (31) engage interspaces (48), defined by adjacent brackets (41 b), for allowing said brackets (41*b*), during a lowering movement of said pushing elements (31), to intercept metallic elements (E) supported by said pushing elements (31) and, during a lifting movement of the pushing elements (31), to be disengaged from metallic elements (E) initially supported on said brackets (41*b*).

17. The method according to claim 12, including the step wherein a cooling unit (6), operatively associated to said chamber (3), operates a cooling of metallic elements (E) exiting from the chamber (3), wherein in said step of operating a cooling of metallic elements (E) a second arm (21) of said gripping element (15*a*), opposite to said first arm, engages at least one support element (V) positioned within said cooling unit.

* * * * *